US005367505A

United States Patent [19]

Tsuchiya et al.

[11] Patent Number: 5,367,505

[45] Date of Patent: Nov. 22, 1994

[54] WATCH WITH DUMB ALARM

[75] Inventors: Hidetaka Tsuchiya; Nobuyuki Uehara; Masami Fukuda; Masao Mafune, all of Tanashi, Japan

[73] Assignee: Citizen Watch Co., Ltd., Tokyo, Japan

[21] Appl. No.: 25,254

[22] Filed: Apr. 12, 1994

[30] Foreign Application Priority Data

Jul. 5, 1991 [JP] Japan ..... 3-060213

[51] Int. Cl.[5] ..... G04B 19/06; G04B 23/02

[52] U.S. Cl. ..... 368/72; 368/230

[58] Field of Search ..... 368/72–74, 368/76, 80, 230, 250, 251; 340/407

[56] References Cited

U.S. PATENT DOCUMENTS

| | | | |
|---|---|---|---|
| 1,483,768 | 2/1924 | Bickerton | 368/230 |
| 1,486,608 | 3/1924 | Schroeder | 368/230 |
| 1,927,765 | 9/1933 | Wisely | 368/230 |
| 2,192,505 | 3/1940 | Raybuck | 368/230 |
| 2,223,243 | 11/1940 | Axelrod | 368/230 |
| 4,456,387 | 6/1984 | Igarashi | 368/230 |
| 4,637,732 | 1/1987 | Jones et al. | 368/109 |
| 4,920,525 | 4/1990 | Meister | 368/250 |
| 5,023,853 | 6/1991 | Kawata et al. | 368/230 |
| 5,043,956 | 8/1991 | Tsukada et al. | 368/255 |

FOREIGN PATENT DOCUMENTS

| | | |
|---|---|---|
| 53-33656 | 3/1978 | Japan . |
| 60-38684 | 2/1985 | Japan . |
| 27597 | 1/1990 | Japan . |
| 29894 | 1/1990 | Japan . |
| 2107089 | 8/1990 | Japan . |

*Primary Examiner*—Vit W. Miska

*Attorney, Agent, or Firm*—Kanesaka & Takeuchi

[57] ABSTRACT

A watch with a dumb alarm has a time drive region which is electrically drivable and an alarm drive region which is drivable by a mechanical drive source. The alarm drive region has an alarm wheel engaging the hour wheel, an eccentric weight rotatably supported in an eccentric position, an alarm lever for urging the hour wheel toward the alarm wheel, the alarm lever having a distal end engageable with an engaging portion on the eccentric weight, an externally operable member for controlling the eccentric weight to start and stop operating, a spiral spring for rotating the eccentric weight, and a wheel train for transmitting drive forces from the spiral spring. When a preset time to be announced comes, the hour wheel engages the alarm wheel to allow the eccentric weight to start operating, and power of the spiral spring is transmitted through the wheel train to the eccentric weight to rotate the eccentric weight to produce vibrations thereof.

12 Claims, 11 Drawing Sheets

WATCH WITH DUMB ALARM

DESCRIPTION

1. Technical field

The present invention relates to a watch with a dumb alarm, for indicating a time with hands and also for indicating a time to be announced with the rotational vibration of an eccentric weight when such a time to be announced arrives, and more particularly to such a watch with a dumb alarm in which the eccentric weight is actuatable by a power source comprising a spiral spring, so that an electric current consumed by the watch will not be increased.

2. Background art

There have heretofore been proposed several watches with dumb alarms for indicating a time to be announced with poking a skin or vibrations, rather than sound.

For example, Japanese laid-open utility model publication No. 2-6291 discloses a watch with a dumb alarm having a rotor drivable by a vibratory body with a piezo-electric element bonded thereto and an eccentric weight mounted on the rotor. When a time to be announced comes, it is indicated by the vibration of the weight that is rotated by the rotor.

Japanese laid-open utility model publication No. 2-107089 shows a watch with a dumb alarm that includes a weight exposed in a watch indicating area so as to be remote from a rear case (the surface of the arm of a wrist watch wearer) for greater a vibrational effect so that the movement of the weight can directly be viewed.

Since the weight is driven by the piezoelectric element or the rotor, however, the watches disclosed in Japanese laid-open utility model publications Nos. 2-6291 and 2-107089 must employ a battery as a drive source. As the electric current consumed by the battery is large, the service life of the battery is short.

To extend the service life of the battery, the battery may be of a large size, or a plurality of batteries may be used. Such an attempt results in a large and thick movement mechanism. Inasmuch as the weight is mounted eccentrically on the rotor drivable by the vibratory body with the piezoelectric element bonded thereto, the drive source and the weight are superimposed one on the other, also resulting in a thick movement.

Therefore, it is an object of the present invention to provide a watch with a dumb alarm which is free of the aforesaid drawbacks, does not consume a large electric current for actuating the watch, has a low-profile movement, mechanism and is well designed.

DISCLOSURE OF THE INVENTION

According to the present invention, there is provided a watch with a dumb alarm for indicating a time to be announced with vibrations, characterized by which includes a time drive region which is electrically drivable and an alarm drive region which is drivable by a mechanical drive source.

More specifically, the time drive region has an hour wheel, a center wheel, a second wheel, and an alarm wheel to which respective hands for indicating an hour, a minute, a second, and an alarm time, respectively, are attached. Also there are a motor for driving the hour wheel, the minute wheel, and the second wheel, a battery for energizing the motor, and an alarm for setting a time to be announced, and the alarm drive region has an alarm wheel engaging the hour wheel, an eccentric weight rotatably supported in an eccentric position, an alarm lever for urging the hour wheel toward the alarm wheel, the alarm lever having a distal end engageable with an engaging portion on the eccentric weight, an externally operable member for controlling the eccentric weight to start and stop operating, a spiral spring for rotating the eccentric weight, and a wheel train for transmitting drive forces from the spiral spring. When a preset time to be announced comes, the hour wheel engages the alarm wheel to allow the eccentric weight to start operating, and power of the spiral spring is transmitted through the wheel train to the eccentric weight to rotate the eccentric weight to produce vibrations thereof.

The watch with the dumb alarm does not consume a large amount of electric power, and the dumb alarm is capable of giving an alarm with vibrations.

Furthermore, the spiral spring can be wound by a stem through a winding transmission wheel train, and forces produced upon unwinding of the spiral spring are transmitted to the eccentric weight through a weight drive wheel train. The stem, the spiral spring, and the eccentric weight are arranged at substantially the same height as viewed in cross section, and the winding transmission wheel train and the weight drive wheel train being disposed on a side of spiral spring opposite to a dial.

The movement mechanism of the watch can thus be of a low profile.

Moreover, a dial and a bottom plate have holes or recesses at respective positions corresponding to the spiral spring and the eccentric weight, for viewing the spiral spring and the eccentric weight therethrough.

The spiral spring and the eccentric weight can be viewed through the holes or recesses. The watch may be well designed with a skeletonic design form.

BEST MODE FOR CARRYING OUT THE INVENTION

Figure 1:
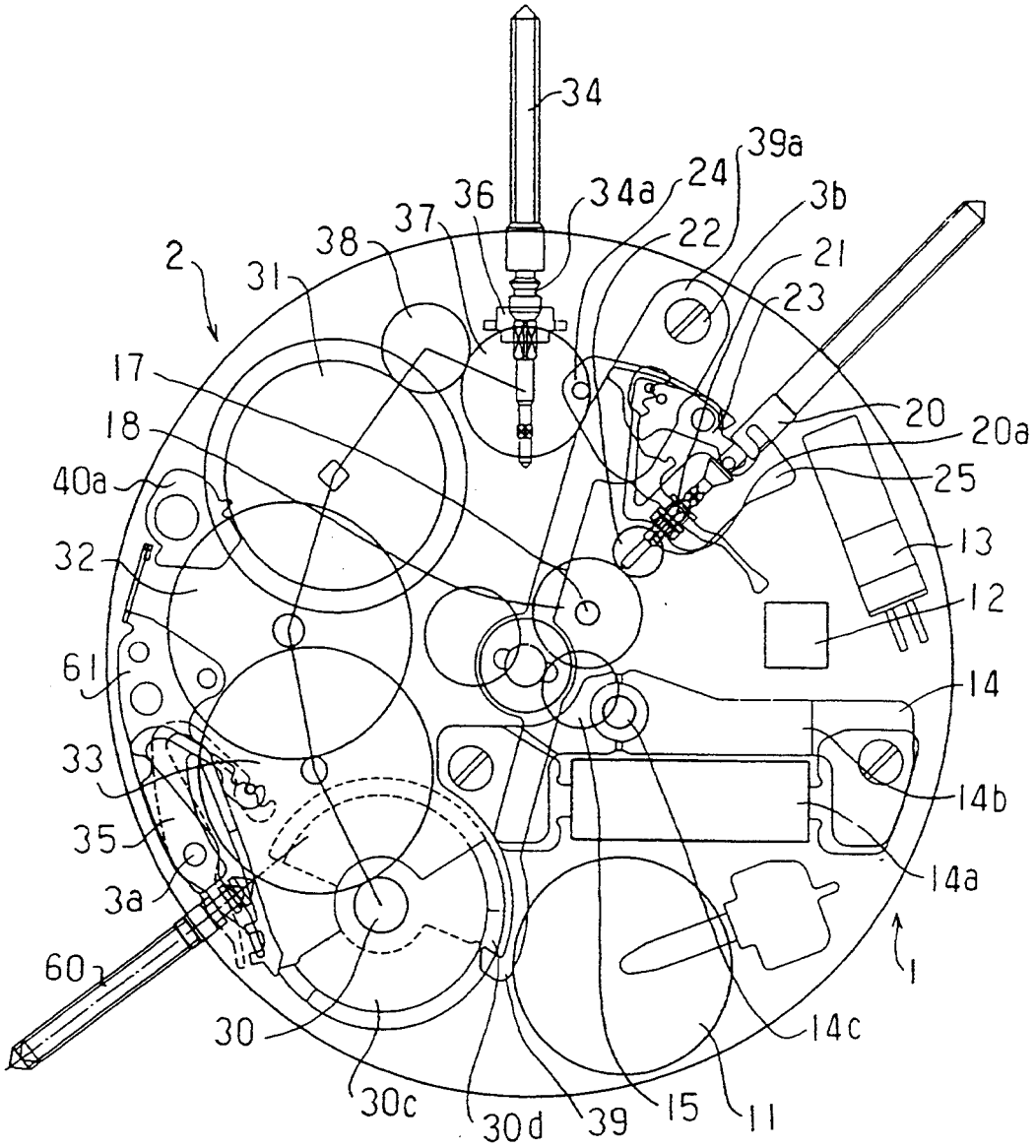
FIG. 1 is a plan view of central parts of a watch according to an embodiment of the present invention, as viewed from a rear cover side thereof.

A preferred embodiment of the present invention will be described below with reference to the accompanying drawings.

A time drive region and an alarm drive region will first be described below with reference to FIGS. 1 through 8.

A watch as shown has a time drive region 1 and an alarm drive region 2. The time drive region 1 and the alarm drive region 2 have parts mounted on a bottom plate 3.

The time drive region 1 employs an ordinary module for indicating a time. More specifically, the time drive region 1 comprises a battery 11 for driving the watch, an IC 12 for controlling an electric system as by outputting a drive signal, a quartz crystal oscillator 13 for generating a reference signal, and a motor 14 composed of a coil unit 14*a*, a stator 14*b*, and a rotor 14*c* for converting an electric signal into mechanical motion. The motion of the motor 14 is reduced in speed by a wheel train 15 whose motion is transmitted through a second wheel 16, a center wheel 17, and a minute wheel 18 to an hour wheel 19.

Figure 3:
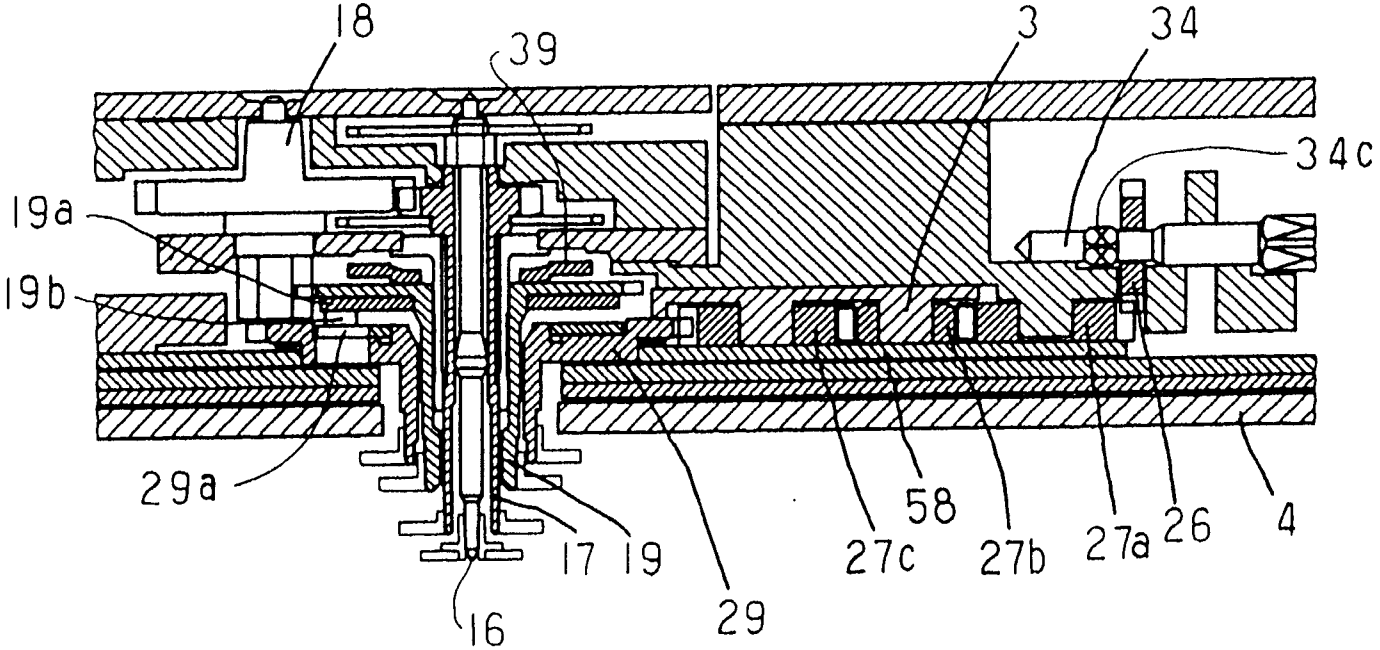
FIG. 3 is a cross-sectional view of an alarm correction transmission wheel train in a movement mechanism of the watch.

To the hour wheel 19, there is fixed an alarm plate 19*a* having a projection 19*b* (see FIG. 3). The motion is transmitted from the second wheel 16 to the center wheel 17 through a third wheel (not shown).

In this module, the motor 14 has a portion disposed between the hour wheel 19 and the battery 11 in the time drive region. Therefore, the parts are efficiently arranged in the time drive region, and a wide space is available for arranging the parts in the alarm drive region.

A stem 20, which functions in the same manner as in the ordinary watches, allows the ordinary time to be corrected when pulled for two steps, and allows the calendar to be corrected when pulled for one step. The stem 20 is in a normal carry-around position when not pulled.

Figure 2:
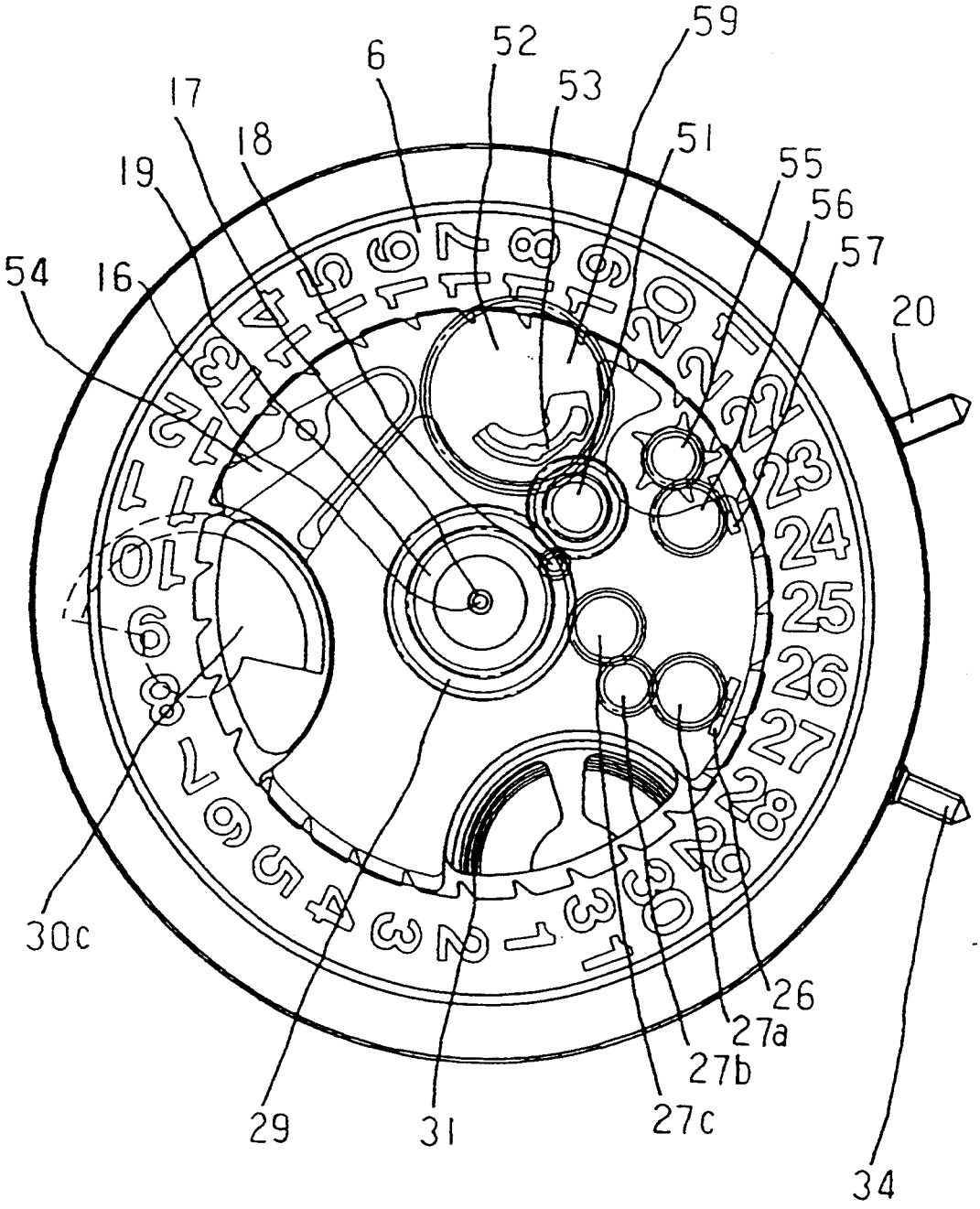
FIG. 2 is a plan view of central parts of the watch as viewed from a dial side thereof.

In FIGS. 1 and 2, when the stem 20 is pulled for two steps, a castle wheel 21 rotates the center wheel 17 and the hour wheel 19 through a setting wheel 22 for correcting the time. A setting lever 23, a yoke 24, and a setting lever spring 25 are ordinary rear components.

The above parts jointly make up the time drive region 1.

The arrangement of the alarm drive region 2 will be described below.

Figure 5:
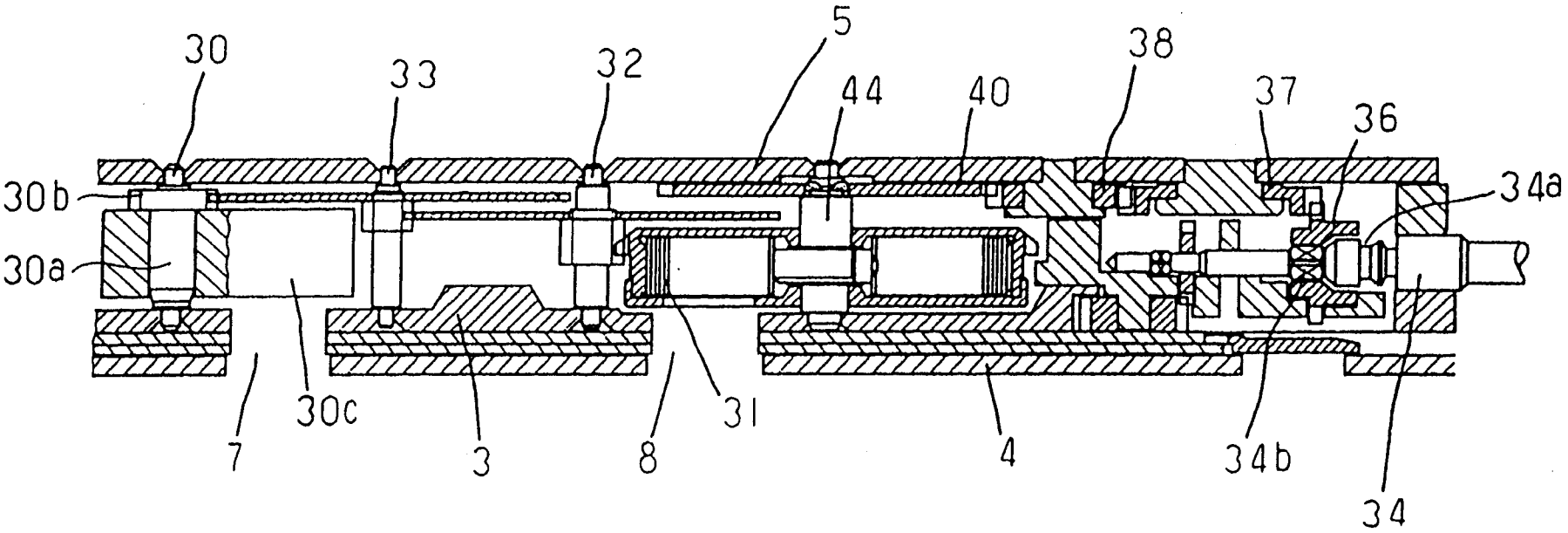
FIG. 5 is a cross-sectional view of a winding transmission wheel train and a weight drive wheel train of the movement mechanism of the watch.

In FIGS. 1 and 5, an eccentric wheel 30 comprises an arbor 30*a* with an integral pinion 30*b*, and an eccentric weight 30*c* is fitted over the arbor 30*a*, so that the eccentric wheel 30 is rotatable in unison with the eccentric weight 30*c*. A spiral spring 31, which serves as a drive source for the eccentric wheel 30, is prevented from rotating backwards by a click 40*a*. Rotational forces are transmitted from the spiral spring 31 to the eccentric wheel 30 through a first drive intermediate wheel 32, a second drive intermediate wheel 33, and the pinion 30*b*. An alarm stem 34 can be brought into a pushed-in position or a pulled-out position.

As shown in FIG. 3, when the alarm stem 34 is in the pulled-out position (pulled for one step), an alarm correction wheel 26 is fitted over a rectangular portion 34*c* of the alarm stem 34 and can be rotated thereby. The alarm correction wheel 26 transmits rotational forces to an alarm wheel 29 through first–third alarm correction intermediate wheels 27*a*–27*c* for correcting an alarm time. The alarm wheel 29 has an engagement hole 29*a* for engaging the projection 19*b* of the hour wheel 19 (see FIG. 4).

Figure 4:
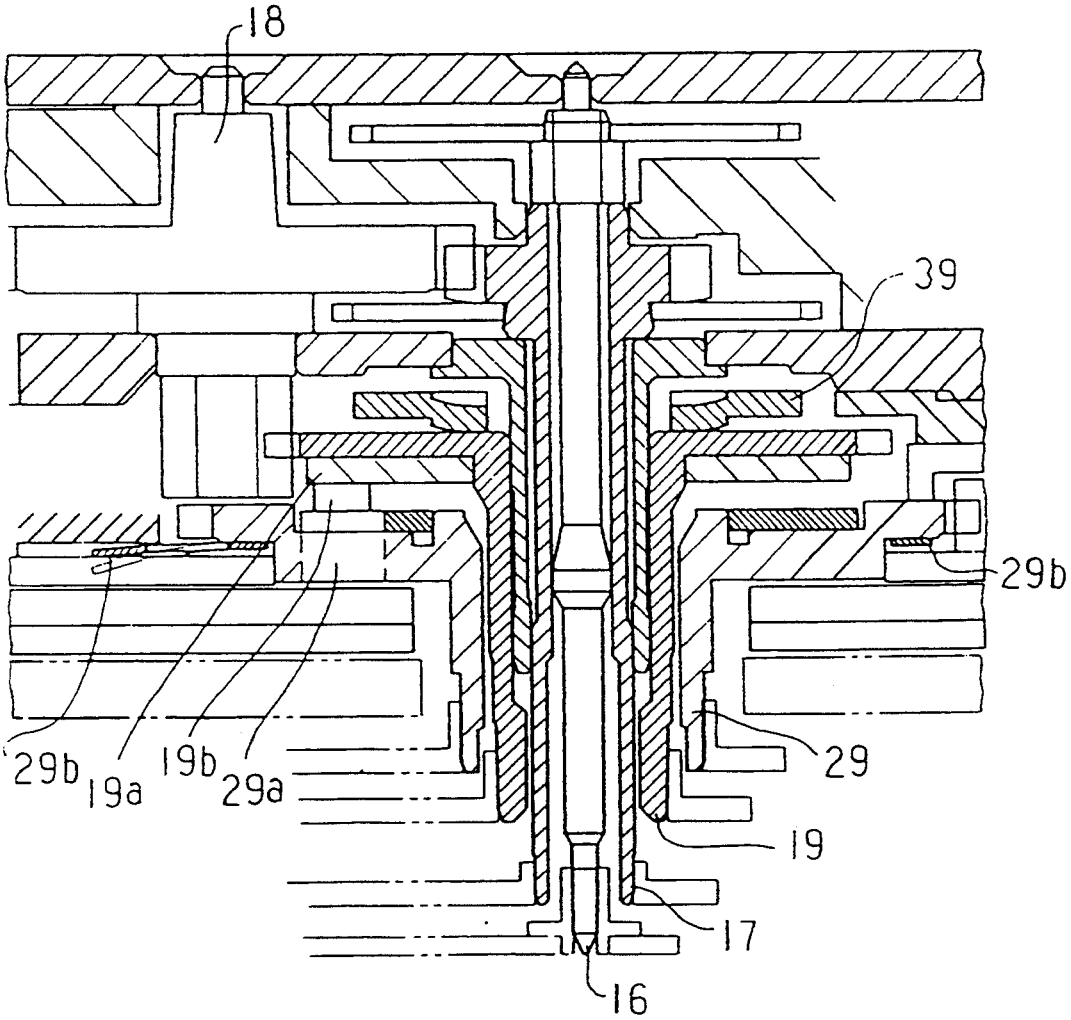
FIG. 4 is an enlarged fragmentary cross-sectional view of a portion shown in FIG. 3.

As shown in FIG. 4, two locations (spaced apart by 180 degrees) on the hour wheel 19 are urged toward the alarm wheel 29 by an alarm lever 39, and the entire outer circumference of the alarm wheel 29 is urged toward the hour wheel 19 by an alarm holder spring 29*b*. Thus, the alarm wheel 29 is rendered stable and the hour wheel 19 is made smooth in its vertical movement, minimizing wobbling movements of the hour hand upon its rotation.

When the alarm stem 34 is in the pushed-in position (not pulled), a second castle wheel 36 engages the rectangular portion 34*b* of the alarm stem 34 and is rotatable thereby. When the alarm stem 34 is in the pulled-out position, the second castle wheel 36 is brought out of engagement with the rectangular portion 34*b* thereof, and can freely be rotated. The second castle wheel 36 serves to transmit rotational forces to the spiral spring 31 through a first transmission wheel 37 and a second transmission wheel 38.

Figure 6:
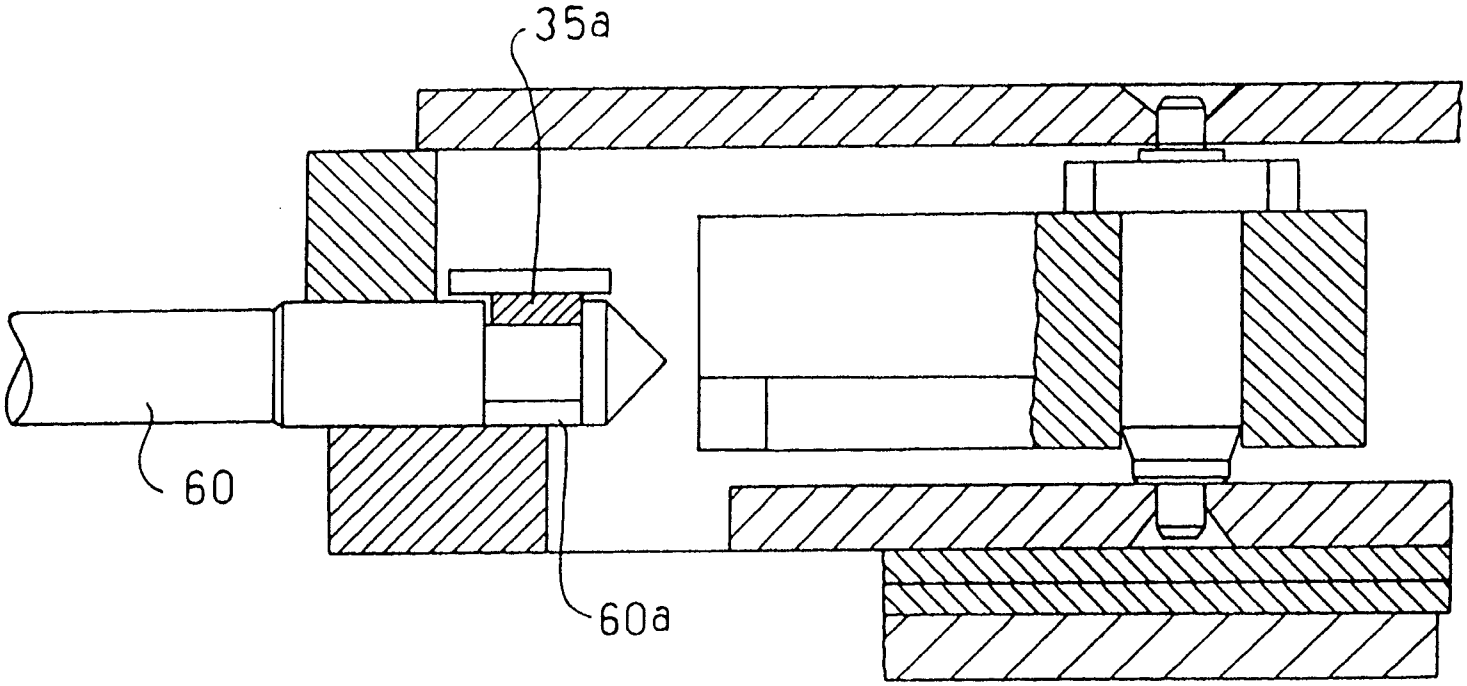
FIG. 6 is an enlarged cross-sectional view showing a push-pull button.
Figure 7:
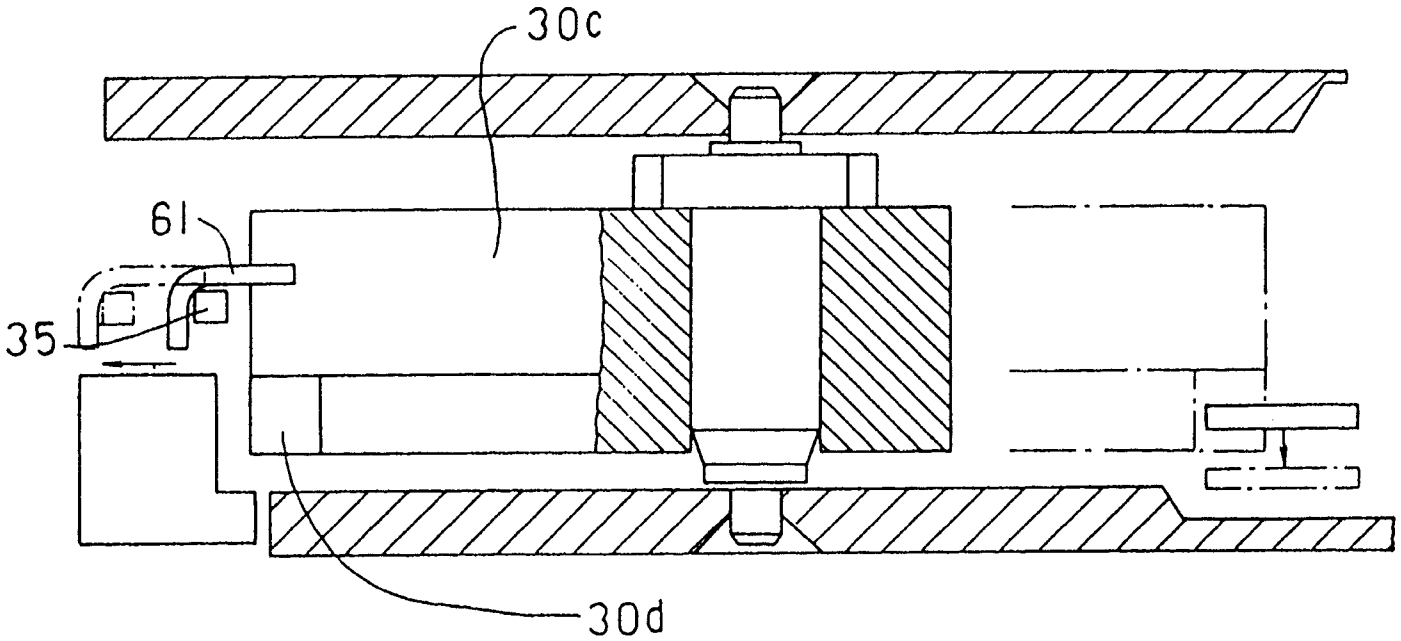
FIG. 7 is a cross-sectional view showing the relationship between a start/stop lever, a stopper, and an eccentric weight of the watch.

A start/stop lever 35 is rotatable about a pin 3*a* mounted on the bottom plate 3. As shown in FIGS. 1, 6, and 7, the start/stop lever 35 has an end 35*a* engaging in a groove 60*a* defined in a push-pull button 60, and an opposite end 35*b* (not shown) held against a stopper 61. When the push-pull button 60 is pushed in, the start/-stop lever 35 moves the stopper 61 toward the eccentric weight 30*c* and brings the stopper 61 into engagement with the eccentric weight 30*c*, as shown in FIG. 7, stopping the eccentric wheel 30 against rotation. When the push-pull button 60 is pulled out, the start/stop lever 35 moves the stopper 61 away from the eccentric weight 30*c* and positions the stopper 61 out of the path of the eccentric weight 30*c*, allowing the eccentric wheel 30 to rotate.

Figure 8:
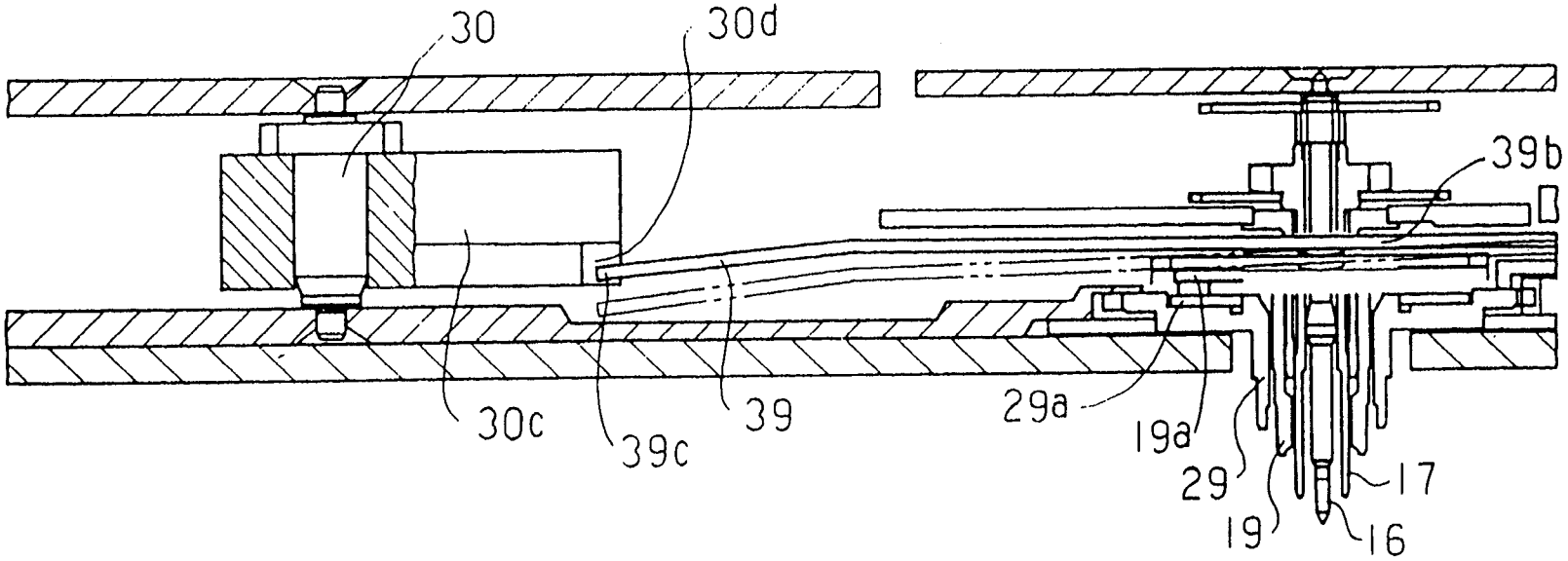
FIG. 8 is a cross-sectional view showing the relationship between the eccentric weight and an alarm lever of the watch.

As illustrated in FIGS. 1, 4, and 8, the alarm lever 39 has a retained portion 39*a* that is retained on the bottom plate 3 by a screw 3*b*, and also has a substantially intermediate engaging portion 39*b* engaging an upper surface of the hour wheel 19. The alarm lever 39 is springy for normally urging the hour wheel 19 downwardly. The alarm lever 39 has a distal end 39*c* which engages an engaging portion 30*d* of the eccentric weight 30*c* when the alarm time is not reached. When the alarm time comes, the distal end 39*c* disengages from the engaging portion 30*d*, permitting the eccentric weight 30*c* to rotate.

As shown in FIG. 7, the eccentric weight 30*c* has its lower peripheral port ion cut off except the engaging portion 30*d* for engaging the alarm lever 39.

Operation of the watch of the above structure will be described below.

The time drive region 1 operates in substantially the same manner as in the conventional watches, and will not be described below.

The alarm drive region 2 will be described below.

A process of setting the watch to an alarm time will first be described. The alarm stem 34 is pulled for one step, and then rotated to cause the alarm correction wheel 26 and the first–third alarm correction intermediate wheels 27*a*–27*c* to rotate the alarm wheel 29 for turning the alarm hand (not shown) to a desired time, e.g., 6 o'clock.

Then, the alarm stem 34 is being pushed in, wherein it is rotated to cause the second castle wheel 36, the first transmission wheel 37, and the second transmission wheel 38 to wind the spiral spring 31. The preparatory process is now completed.

If an alarm is to be given at 6 o'clock which is the alarm time, then the push-pull button 60 is pulled for one step to make the eccentric weight 30*c* rotatable.

As the time passes and when the hour hand (not shown) points to 6 o'clock, the projection 19*b* of the hour wheel 19 falls into the engagement hole 29*a* of the alarm wheel 29. The engaging portion 39*b* of the alarm lever 39 which is held against the upper surface of the hour wheel 19 also moves downwardly with the hour wheel 19, and the distal end 39*c* of the alarm lever 39 drops to a position (shown by the alarm lever 39 itself) indicated by the thinner lines in FIG. 8. The distal end 39*c* of the alarm lever 39 is now brought out of engagement with the engaging potion 30*d* of the eccentric weight 30*c*, whereupon the eccentric wheel 30 is freely rotatable.

Since the spiral spring 31 is wound up, the force of the spiral spring 31 is transmitted through the first drive intermediate wheel 32 and the second drive intermediate wheel 33 to rotate the eccentric wheel 30. The eccentric weight 30*c* integral with the eccentric wheel 30 now rotates to produce vibrations which are detected by the arm of the wearer of the watch, thus indicating the alarm time.

To stop the rotation of the eccentric weight 30*c*, the push-pull button 60 is pushed in to move the opposite end 35*b* of the start/stop lever 35 toward the eccentric weight 30*c* until the stopper 61 engages the eccentric weight 30*c*. When the stopper 61 engages the eccentric weight 30*c*, the rotation thereof is stopped.

The arrangement of parts in the movement will be described below with reference to FIGS. 1, 5, 9 through 11.

The watch described here is a watch with a dumb alarm, which can indicate a time and a date and also can indicate a time to be announced with the rotational vibration of the eccentric weight when such a time to be announced arrives. The watch comprises a wheel train for driving a date ring, a date correction wheel train for correcting the date, a spiral spring as a power source for the eccentric weight, a winding transmission wheel train for transmitting winding forces for the spiral spring from a stem, and a weight drive wheel train for transmitting forces produced by unwinding of the spiral spring to the eccentric weight. The wheel train for driving the date ring and the date correction wheel train, and the winding transmission wheel train and the weight drive wheel train are arranged so as not to be superimposed in plan.

Figure 9:
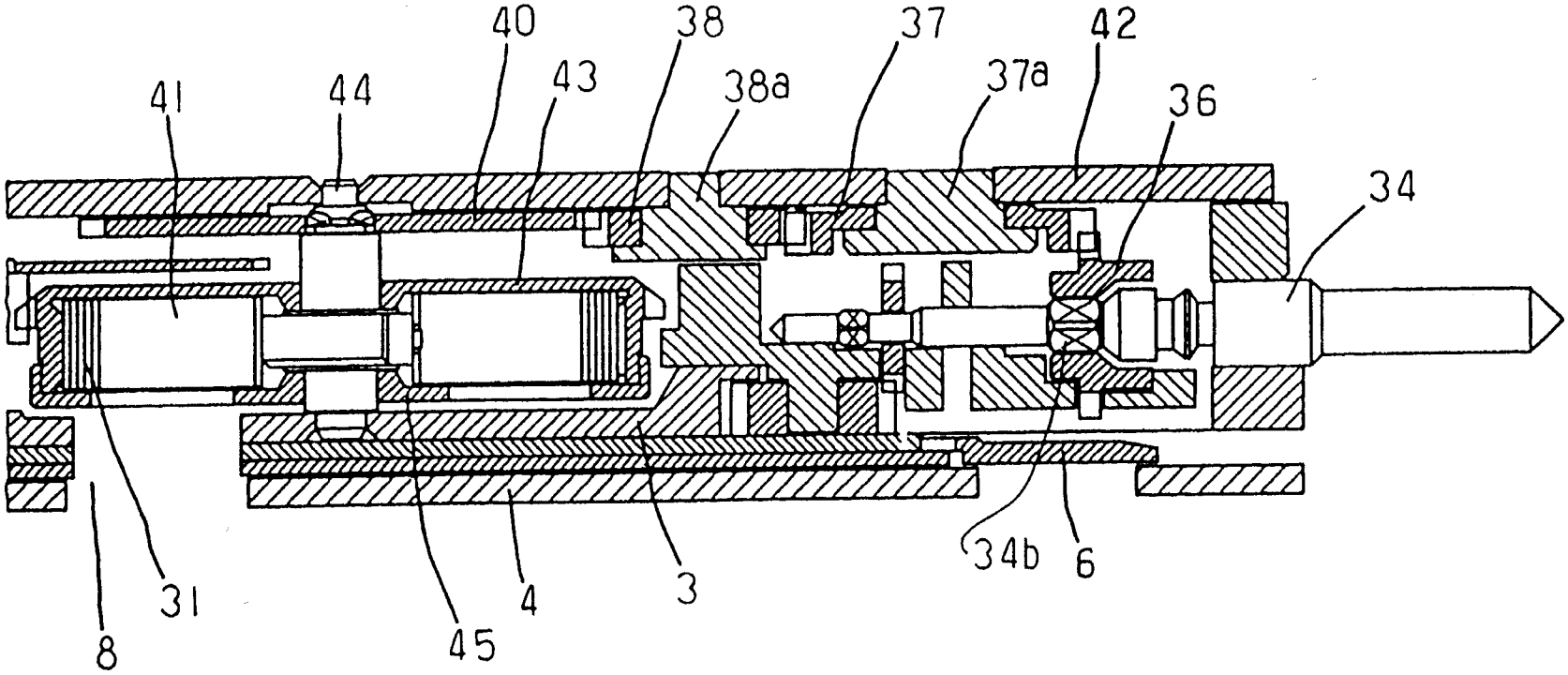
FIG. 9 is a cross-sectional view of the winding transmission wheel train of the movement mechanism of the watch.

FIG. 9 shows the winding transmission wheel train in fragmentary cross section. The winding transmission wheel train is composed of the alarm stem 34, the second castle wheel 36, the first transmission wheel 37, the second transmission wheel 38, a ratchet wheel 40, and a barrel wheel 41. When the alarm stem 34 is not pulled, the second castle wheel 36 engages the alarm stem 34 to wind the spiral spring. The first transmission wheel 37 and the second transmission wheel 38 are fixed by respective shafts 37*a*, 38*a* to a wheel train support 42 that is positioned on one side of the spiral spring 31 opposite to a dial 4. The barrel wheel 41 comprises the spiral spring 31, a barrel 43, a barrel arbor 44, and a barrel cover 45, and is rotatably supported by the bottom plate 3 and the wheel train support 42.

Figure 10:
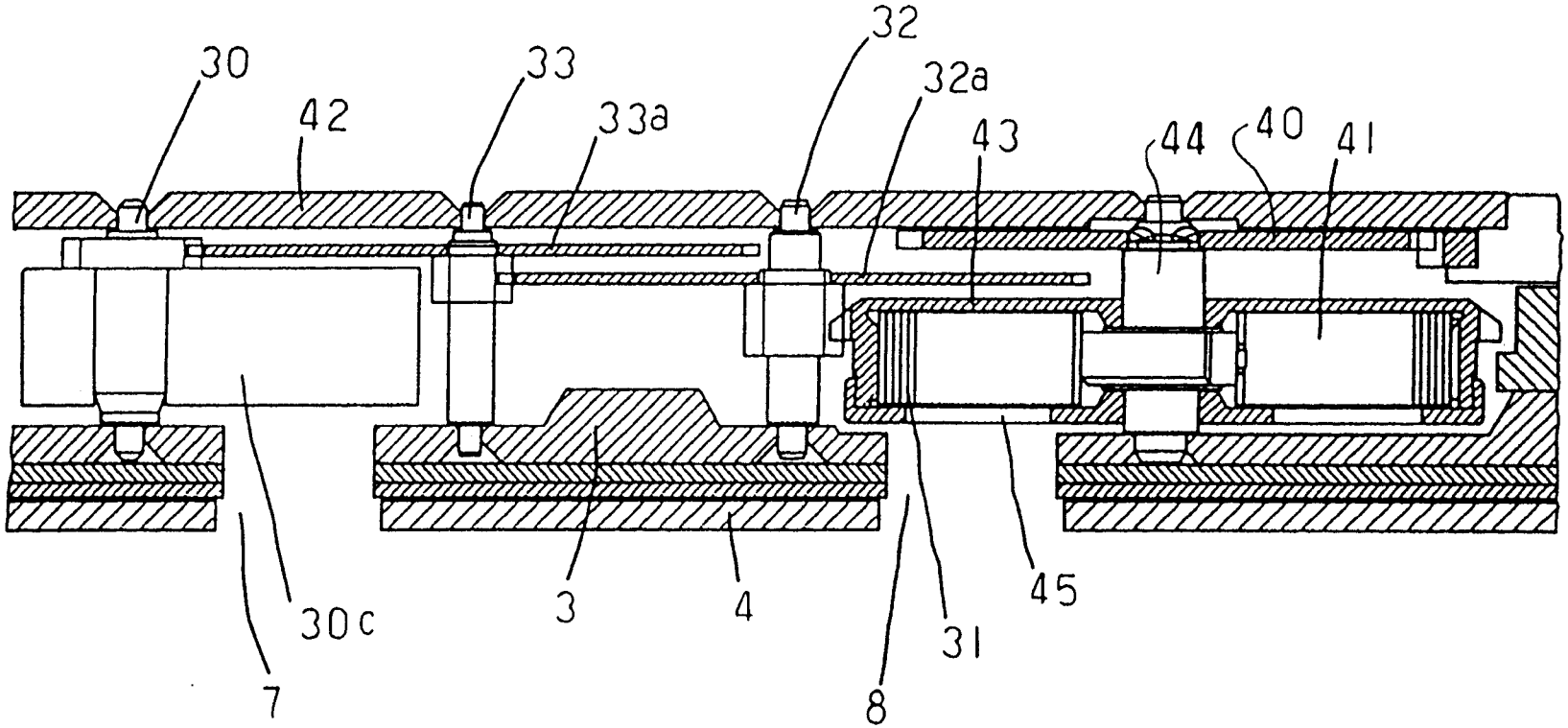
FIG. 10 is a cross-sectional view of the weight drive wheel train of the movement mechanism of the watch.

FIG. 10 shows the weight drive wheel train in fragmentary cross section. The weight drive wheel train is composed of the barrel 43, the first drive intermediate wheel 32, the second drive intermediate wheel 33, and the eccentric wheel 30, and is rotatably supported by the bottom plate 3 and the wheel train support 42. The power from the spiral spring 31 is transmitted through the first and second drive intermediate wheels 32, 33 to the eccentric wheel 30, rotating the eccentric weight 30*c* of the eccentric wheel 30. The first drive intermediate wheel 32 comprises a gear 32*a* and the second drive intermediate wheel 33 comprises a gear 33*a*, and these gears 32*a*, 33*a* are disposed near the wheel train support 42 (on one side of the spiral spring 31 and the eccentric weight 30*c* opposite to the dial 4).

Figure 11:
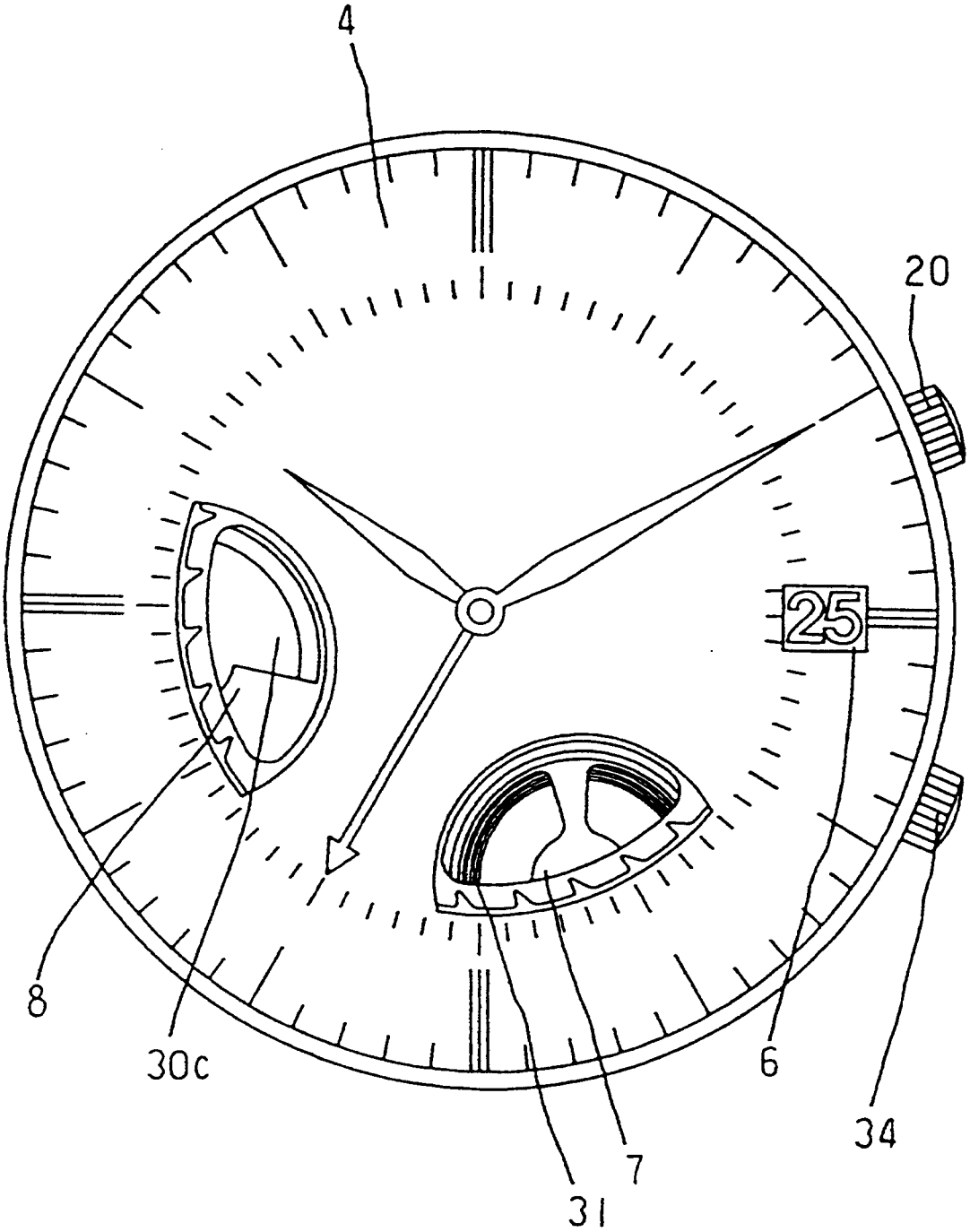
FIG. 11 is a view showing an appearance of the watch in its complete form.

As shown in FIG. 11, windows 7, 8 in the form of recesses are defined in the barrel cover 45, the dial 4, and the bottom plate 3 at respective positions corresponding to the spiral spring 31 and the eccentric weight 30*c*, so that the spiral spring 31 and the eccentric weight 30*c* can be viewed through the windows 7, 8. As shown in FIG. 5, the winding transmission train 37, 38 and the weight drive wheel train 32, 33 are arranged at substantially the same height as viewed in cross section.

FIG. 2 is a plan view of the movement mechanism as viewed from the dial side. In FIG. 2, the second wheel 16, the center wheel 17, and the hour wheel 18 jointly serve as a wheel train for driving second, minute, and hour hands. The movement mechanism has a date ring transmission wheel 51, a date ring driving wheel 52, and a date ring pawl 53 which drives a date ring 6. A jumper lever 54 positions the date ring 6. The movement mechanism also has a quick correction wheel 55, a first quick correction transmission wheel 56, and a second quick correction transmission wheel 57. When the stem 20 is pulled for one step, the second quick correction transmission wheel 57 engages the stem 20 for correcting the date.

FIG. 3 shows in cross section the alarm wheel correction transmission wheels 27*a*, 27*b*, 27*c* for transmitting correcting motion from the alarm stem 34 to the alarm wheel 29, and central parts of the movement mechanism. The alarm wheel 29 and the alarm wheel correction transmission wheels 27*a*, 27*b*, 27*c* are positioned on the side of the bottom plate 3 near the dial 4, and are held by an alarm wheel holder plate 58. A date ring drive wheel train which is composed of the date ring 6, the date ring transmission wheel 51, the date ring driving wheel 52, and the jumper lever 54, and a date correction wheel train which is composed of the quick correction wheel 55 and the quick correction transmission wheel 56 are also positioned on the side of the bottom plate 3 near the dial 4 (not shown in cross section).

The alarm wheel correction transmission wheels 27*a*, 27*b*, 27*c*, the date ring drive wheel train, and the date correction wheel train are located so as not to be superimposed on the spiral spring 31 and the eccentric weight 30*c* as viewed in plan (see FIG. 4).

INDUSTRIAL APPLICABILITY

As described above, the watch with the dumb alarm according to the present invention can be used as a variety of watches, and is particularly suitable for use as a wrist watch.

We claim:

1. A watch with a dumb alarm for indicating a time to be announced with vibration, comprising:

a casing, a time drive region situated in the casing, said time drive region being driven electrically and including an hour wheel with an hour hand for indicating an hour, a center wheel with a minute hand for indicating a minute, a second wheel with a second hand for indicating a second, a motor engaging said hour wheel, said minute wheel and said second wheel to drive the same, and a battery electrically connected to said motor for energizing the motor, and an alarm drive region situated in the casing, said alarm drive region being driven by a mechanical drive source and including an alarm wheel with an alarm hand for setting and indicating an alarm time, said alarm wheel being arranged coaxially with said hour wheel driven by said motor and to be engageable therewith, an eccentric weight eccentrically rotatably situated in the casing and having an engaging portion, an alarm lever situated near said alarm wheel for urging said hour wheel toward the alarm wheel and having a distal end engageable with said engaging portion of the eccentric weight, an alarm stem attached to the casing to be engageable with said alarm wheel for controlling stopping and starting operations of the eccentric weight, a spiral spring situated in said casing for operating the eccentric weight, a weight drive wheel train situated between the spiral spring and the eccentric weight for transmitting drive force from said spiral spring to said eccentric weight, and a winding transmission wheel train situated between the alarm stem and the spiral spring for winding said spiral spring by said alarm stem, said alarm stem, spiral spring and eccentric weight being arranged at substantially same horizontal level in the casing so that when a preset time to be announced comes, said hour wheel engages said alarm wheel to allow said eccentric weight to start operating, and the drive force of said spiral spring is transmitted through said weight drive wheel train to said eccentric weight to rotate said eccentric weight to produce vibration.

2. A watch with a dumb alarm according to claim 1, wherein said winding transmission wheel train and said weight drive wheel train are disposed on a side of spiral spring opposite to a dial.

3. A watch with a dumb alarm according to claim 2, wherein a dial and a bottom plate have holes or recesses defined therein at respective positions corresponding to said spiral spring and said eccentric weight, for viewing said spiral spring and said eccentric weight therethrough.

4. A watch with a dumb alarm according to claim 2, wherein at least one of said spiral spring and said eccentric weight is disposed on a 6 o'clock side of a time indicting area.

5. A watch with a dumb alarm according to claim 2, further including a dating mechanism comprising a wheel train for driving a date ring and a date correction wheel train for correcting a date.

6. A watch with a dumb alarm according to claim 5, wherein the wheel train for driving the date ring, the date correction wheel train for correcting the date, the spiral spring for driving said eccentric weight, the winding transmission wheel train for transmitting forces to wind the spiral spring from the stem, and the weight drive wheel train for transmitting forces produced upon unwinding of said spiral spring to said eccentric weight, are arranged so as not to be superimposed as viewed in plan.

7. A watch with a dumb alarm according to claim 2, wherein said motor has a portion disposed between said hour wheel and said battery in said time drive region.

8. A watch with a dumb alarm according to claim 2, wherein two locations on the hour wheel are urged toward the alarm wheel by the alarm lever, and the entire outer circumference of the alarm wheel is urged toward the hour wheel by an alarm holder spring.

9. A watch with a dumb alarm according to claim 2, wherein said eccentric weight has its lower peripheral portion cut off except the engaging portion for engaging an alarm lever.

10. A watch with a dumb alarm according to claim 1, wherein said spiral spring is located between the weight drive wheel train and the winding transmission wheel train.

11. A watch with a dumb alarm according to claim 10, wherein said alarm drive region further includes an alarm holder spring at a side opposite to the alarm lever relative to the alarm wheel so that the alarm wheel and the hour wheel are urged toward each other by the alarm lever and the alarm holder spring.

12. A watch with a dumb alarm according to claim 11, wherein said time drive region and said alarm drive region are arranged laterally side by side in said casing and occupy nearly half respectively.

* * * * *